US007291187B2

(12) United States Patent
Welch et al.

(10) Patent No.: US 7,291,187 B2
(45) Date of Patent: Nov. 6, 2007

(54) SCENTED CANDLES

(75) Inventors: Robert Gary Welch, Mason, OH (US); Jiten Odhavji Dihora, Cincinnati, OH (US); Todd Stephen Alwart, Somerville, MA (US)

(73) Assignee: The Procter & Gamble Company, Cincinnati, OH (US)

( * ) Notice: Subject to any disclaimer, the term of this patent is extended or adjusted under 35 U.S.C. 154(b) by 266 days.

(21) Appl. No.: 10/293,040

(22) Filed: Nov. 13, 2002

(65) Prior Publication Data

US 2003/0064336 A1 Apr. 3, 2003

Related U.S. Application Data

(63) Continuation of application No. PCT/US02/28321, filed on Sep. 6, 2002.

(60) Provisional application No. 60/317,613, filed on Sep. 6, 2001.

(51) Int. Cl.
*C11C 5/00* (2006.01)
*F23D 3/16* (2006.01)

(52) U.S. Cl. ..... 44/275; 431/288

(58) Field of Classification Search ..... 44/275; 431/288

See application file for complete search history.

(56) References Cited

U.S. PATENT DOCUMENTS

| | | | | |
|---|---|---|---|---|
| 3,175,876 | A * | 3/1965 | Fredericks | 422/126 |
| 3,359,092 | A * | 12/1967 | Dunham, Jr. et al. | 504/162 |
| 3,898,039 | A * | 8/1975 | Lin | 422/125 |
| 4,539,135 | A | 9/1985 | Ramachandran et al. | |
| 4,713,193 | A | 12/1987 | Tai | |
| 4,873,000 | A | 10/1989 | Weller | |
| 5,026,551 | A | 6/1991 | Yorozu et al. | |
| 5,336,665 | A | 8/1994 | Garner-Gray et al. | |
| 5,478,501 | A | 12/1995 | Rau | |
| 5,480,575 | A | 1/1996 | Altieri et al. | |
| 5,691,202 | A | 11/1997 | Wan et al. | |
| 5,858,959 | A | 1/1999 | Surutzidis et al. | |
| 5,955,419 | A | 9/1999 | Barket, Jr. et al. | |
| 5,965,515 | A | 10/1999 | Rau | |
| 5,993,854 | A | 11/1999 | Needleman et al. | |
| 5,997,901 | A | 12/1999 | Mills | |
| 6,068,472 | A * | 5/2000 | Freeman et al. | 431/291 |

FOREIGN PATENT DOCUMENTS

| | | | |
|---|---|---|---|
| CA | 2317022 | | 11/2000 |
| EP | 0 816 484 | A2 | 1/1998 |
| JP | 56011995 | A * | 2/1981 |
| JP | 04218583 | A * | 8/1992 |
| JP | 2000-239694 | * | 9/2000 |
| WO | WO 93/08255 | | 4/1993 |
| WO | WO 97/34981 | | 9/1997 |
| WO | WO 99/21953 | | 5/1999 |

OTHER PUBLICATIONS

Glade Plugins Night Light Candle Scents (scratch -n- sniff).*

* cited by examiner

*Primary Examiner*—Cephia D. Toomer
(74) *Attorney, Agent, or Firm*—Jason J. Camp; Julia A. Glazer; Brent M. Peebles

(57) ABSTRACT

Scented candles comprise: (a) candle manufacturing material, (b) perfume-loaded porous inorganic carrier particles, and (c) at least one wick. Methods for manufacturing a scented candle comprise: (a) loading porous inorganic carrier particles with perfume, (b) adding the perfume-loaded porous inorganic carrier particles to candle manufacturing material, and (c) providing the candle manufacturing material with a wick.

17 Claims, No Drawings

SCENTED CANDLES

CROSS REFERENCE TO RELATED APPLICATIONS

This is a continuation of International Application PCT/US02/28321, with an international filing date of Sep. 6, 2002, which claims benefit of U.S. Provisional Application Ser. No. 60,317,613, filed Sep. 6, 2001.

FIELD OF THE INVENTION

The present invention relates to scented candles that release desirable fragrances and/or for use in other aromatherapy applications. The invention additionally relates to methods for manufacturing scented candles.

BACKGROUND OF THE INVENTION

Bolstered by scientific evidence touting the role of fragrance and the benefits of aromatherapy in modulating human emotions, consumer demand for scented candles is exploding. As more candle products have entered the market, consumers have become more discriminating about the quality of the candles and fragrances thereof. Hence, consumers have expressed a desire for increased fragrance longevity, both before and after burning, and increased fragrance intensity during burning of candles.

The incorporation of perfume oil in candle wax is often difficult to achieve in a quantity that ensures the release of a suitable level of fragrance into the atmosphere during candle burning. Furthermore, the incorporated perfumes, particularly smaller, highly volatile perfumes, tend to volatize during the candle manufacturing process, and to migrate and volatize from the finished candle during storage. Incorporation of larger quantities of perfume and/or perfume molecules of a relatively large size, tend to soften conventional candle waxes, resulting in an undesirable loss of rigidity in the candle structure.

Typically, candles are made by either compression or extrusion processes. In a compression process, powdered paraffin wax is compressed, drilled, and wicked. These candles typically burn less effectively because of air pockets formed in the wax. In an extrusion process, the paraffin wax typically is melted, placed into a mold, cooled, and ejected from the mold. The molded candle is then drilled and the wick is placed through the hole. These candles typically provide high initial odor, for example, at the point of purchase and if burned immediately. However, the odor typically disappears after a short period of time. These candles burn completely, but do not allow incorporation of higher levels of fragrance or more volatile fragrances because much of the volatile perfume active is lost during the candle making process. The scented candle-making industry, therefore, has long searched for an effective perfume delivery system which allows for incorporation of greater amounts of the perfume and which provides for a long-lasting fragrance to the product.

SUMMARY OF THE INVENTION

It is therefore an object of the present invention to provide scented candles and methods for manufacturing such. It is a more specific object to provide scented candles exhibiting good and long lasting fragrance release.

In one embodiment, the invention is directed to a scented candle comprising candle manufacturing material, perfume-loaded porous inorganic carrier particles and at least one wick. In another embodiment, the present invention is directed to methods for manufacturing a scented candle. The methods comprise loading porous inorganic carrier particles with perfume, adding the perfume-loaded porous inorganic carrier particles to candle manufacturing material, and providing the candle manufacturing material with a wick.

The present invention provides scented candles that produce intense and long-lasting fragrances. The present invention also overcomes many of the conventional limitations on the amounts and types of candle perfumes employed in the prior art. The present invention further provides methods for manufacturing a scented candle that produces intense and long-lasting fragrances.

These and additional objects and advantages will be more fully apparent in view of the following detailed description.

DETAILED DESCRIPTION

The present invention is directed to scented candles and particularly to scented candles capable of delivering intense and long-lasting fragrances. The inventive scented candles comprise candle manufacturing material, perfume-loaded porous inorganic carrier particles, and wick material. Each of these components is described in detail below. The present invention is further directed to methods for manufacturing a scented candle. The methods comprise loading perfume onto the porous inorganic carrier molecule, adding the perfume-loaded porous inorganic to the candle manufacturing material, and adding at least one wick.

The methods may optionally include additional steps, for example encapsulating or coating the perfume-loaded inorganic carrier particles before their addition to the candle manufacturing material, as described in detail below. Such encapsulation processes and materials are well described in U.S. Pat. No. 6,025,319 to Surutzidis, et al., U.S. Pat. No. 6,048,830 to Gallon, et al. and U.S. Pat. No. 6,245,732 B1 to Gallon, et al., all commonly assigned to The Procter & Gamble Company and all incorporated herein by reference.

Candle Manufacturing Material

Candle manufacturing material is used to describe those materials known in the art for candle making. Candle manufacturing materials for use herein include, but is not limited to, vegetable derived waxes such as arrayan, carnauba, sugar cane, hydrogenated castor oil, cauasssu, canelilla, raffia, palm, esparto, and cotton wax; animal waxes such as beeswax, ghedda, Chinese insect, shellac, spermaceti, and lanolin wax; mineral waxes such as paraffin, microcrystalline, ozokerite, montan and syncera wax; and synthetic waxes such as CARBOWAX®, ABRIL® waxes, ARMID® and ARMOWAX® (Armour & Co.), CHLORAX® chlorinated paraffin wax (Watford Chemical Co.), and POLYWAX® (Pertolite, Co.). Manufacturing materials can also include, but are not limited to polyamide reins, aliphatic amides, aliphatic alcohols, divalent alcohols, polyvalent alcohols, emulsifiers, oils such as vegetable, palm, or soy bean oil or the like, vegetable fat, stearic acid, polypropylene glycol or derivatives thereof. Combinations of such ingredients can also be used.

Thermoplastic materials can be incorporated into the candle manufacturing material to change the melting flow temperature, as is known in the art. Such materials include, but are not limited to, polypropylenes, polyesters, polyvinyl chlorides, tristarch acetates, polyethylene oxides, polypropylene oxides, polyvinylidene chloride or fluoride, polyvinyl alcohols, polyvinyl acetates, polyacrylates, polymethacrylates, vinyl functional polymers, urethanes, polycarbonates, polylactones, hydrogenated polyolefins such as polyisobutene, and blends thereof.

In one embodiment, the candle manufacturing materials comprise one or more paraffin waxes. Preferably, the candle manufacturing material has a melting point of from about 40° C. to about 100° C., and most preferably from about 60° C. to about 80° C.

Perfume-Loaded Porous Inorganic Carrier Particles

The second ingredient of the present inventive scented candle comprises perfume-loaded porous inorganic carrier particles. While not wishing to be bound by theory, it is believed that these particles can facilitate delivery of a more intense and/or longer-lasting fragrance.

a) Perfume:

As used herein the term "perfume" is used to indicate any odoriferous material that is "loaded on" the porous inorganic carrier particles and subsequently released into the candle manufacturing material and/or into the atmosphere. The perfume will most often be liquid at about 25° C. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g. rose extract, violet extract, lilac and the like. The perfumes can also be formulated to provide desirable fruity odors, e.g. lime, lemon, and orange. Further, it is anticipated that so-called "designer fragrances" that are typically applied directly to the skin may be used as desired. Likewise, the perfumes employed in the candles of the present invention may be selected for an aromatherapy effect, such as providing a relaxing or invigorating mood. As such, any material that exudes a pleasant or otherwise desirable odor can be used as a perfume active in the compositions and articles of the present invention.

In one embodiment, at least about 25%, more specifically at least about 50%, even more specifically at least about 75%, by weight of the perfume is composed of fragrance material selected from the group consisting of aromatic and aliphatic esters having molecular weights from about 130 to about 250; aliphatic and aromatic alcohols having molecular weights from about 90 to about 240; aliphatic ketones having molecular weights from about 150 to about 260; aromatic ketones having molecular weights from about 150 to about 270; aromatic and aliphatic lactones having molecular weights from about 130 to about 290; aliphatic aldehydes having molecular weights from about 140 to about 200; aromatic aldehydes having molecular weights from about 90 to about 230; aliphatic and aromatic ethers having molecular weights from about 150 to about 270; and condensation products of aldehydes and amines having molecular weights from about 180 to about 320; and essentially free from nitromusks and halogenated fragrance materials.

More specifically, in a further embodiment, at least about 25%, at least about 50%, or at least about 75%, by weight of the perfume is composed of fragrance material selected from the group consisting of those set forth in the following table:

| Common Name | Chemical Type | Chemical Name | ~M.W. |
|---|---|---|---|
| Adoxal | aliphatic aldehyde | 2,6,10-trimethyl-9-undecen-1-al | 210 |
| allyl amyl glycolate | ester | allyl amyl glycolate | 182 |
| allyl cyclohexane propionate | ester | allyl-3-cyclohexyl propionate | 196 |
| Amyl acetate | ester | 3-methyl-1-butanol acetate | 130 |
| Amyl salicylate | ester | amyl salicylate | 208 |
| Anisic aldehyde | aromatic aldehyde | 4-methoxy benzaldehyde | 136 |
| Aurantiol | schiff base | condensation product of methyl anthranilate and hydroxycitronellal | 305 |
| Bacdanol | aliphatic alcohol | 2-ethyl-4-(2,2,3-trimethyl-3-cyclopenten-1-yl)-2-buten-1-ol | 208 |
| benzaldehyde | aromatic aldehyde | benzaldehyde | 106 |
| benzophenone | aromatic ketone | benzophenone | 182 |
| benzyl acetate | ester | benzyl acetate | 150 |
| benzyl salicylate | ester | benzyl salicylate | 228 |
| beta damascone | aliphatic ketone | 1-(2,6,6-trimethyl-1-cyclo-hexen-1-yl)-2-buten-1-one | 192 |
| beta gamma hexanol | alcohol | 3-hexen-1-ol | 100 |
| Buccoxime | aliphatic ketone | 1,5-dimethyl-oxime bicyclo[3,2,1] octan-8-one | 167 |
| Cedrol | alcohol | octahydro-3,6,8,8-tetramethyl-1H-3A,7-methanoazulen-6-ol | 222 |
| Cetalox | ether | dodecahydro-3A,6,6,9A-tetramethylnaphtho[2,1B]-furan | 236 |
| cis-3-hexenyl acetate | ester | cis-3-hexenyl acetate | 142 |
| cis-3-hexenyl salicylate | ester | beta, gamma-hexenyl salicylate | 220 |
| Citronellol | alcohol | 3,7-dimethyl-6-octenol | 156 |
| citronellyl nitrile | nitrile | geranyl nitrile | 151 |
| Clove stem oil | natural | | |
| Coumarin | lactone | coumarin | 146 |
| cyclohexyl salicylate | ester | cyclohexyl salicylate | 220 |
| Cymal | aromatic aldehyde | 2-methyl-3-(para iso propyl phenyl)propionaldehyde | 190 |

-continued

| Common Name | Chemical Type | Chemical Name | ~M.W. |
|---|---|---|---|
| Decyl aldehyde | aliphatic aldehyde | decyl aldehyde | 156 |
| delta damascone | aliphatic ketone | 1-(2,6,6-trimethyl-3-cyclo-hexen-1-yl)-2-buten-1-one | 192 |
| dihydromyrcenol | alcohol | 3-methylene-7-methyl octan-7-ol | 156 |
| dimethyl benzyl carbinyl acetate | ester | dimethyl benzyl carbinyl acetate | 192 |
| Ethyl vanillin | aromatic aldehyde | ethyl vanillin | 166 |
| Ethyl-2-methyl butyrate | ester | ethyl-2-methyl butyrate | 130 |
| ethylene brassylate | macrocyclic lactone | ethylene tridecan-1,13-dioate | 270 |
| Eucalyptol | aliphatic epoxide | 1,8-epoxy-para-menthane | 154 |
| Eugenol | alcohol | 4-allyl-2-methoxy phenol | 164 |
| Exaltolide | macrocyclic lactone | cyclopentadecanolide | 240 |
| flor acetate | ester | dihydro-nor-cyclopentadienyl acetate | 190 |
| Florhydral | aromatic aldehyde | 3-(3-isopropylphenyl) butanal | 190 |
| Frutene | ester | dihydro-nor-cyclopentadienyl propionate | 206 |
| Galaxolide | ether | 1,3,4,6,7,8-hexahydro-4,6,6,7,8,8-hexamethylcyclopenta-gamma-2-benzopyrane | 258 |
| gamma decalactone | lactone | 4-N-hepty-4-hydroxybutanoic acid lactone | 170 |
| gamma dodecalactone | lactone | 4-N-octyl-4-hydroxy-butanoic acid lactone | 198 |
| Geraniol | alcohol | 3,7-dimethyl-2,6-octadien-1-ol | 154 |
| geranyl acetate | ester | 3,7-dimethyl-2,6-octadien-1-yl acetate | 196 |
| geranyl nitrile | ester | 3,7-diemthyl-2,6-octadienenitrile | 149 |
| Helional | aromatic aldehyde | alpha-methyl-3,4, (methylenedioxy) hydrocinnamaldehyde | 192 |
| Heliotropin | aromatic aldehyde | heliotropin | 150 |
| Hexyl acetate | ester | hexyl acetate | 144 |
| Hexyl cinnamic aldehyde | aromatic aldehyde | alpha-n-hexyl cinnamic aldehyde | 216 |
| Hexyl salicylate | ester | hexyl salicylate | 222 |
| hydroxyambran | aliphatic alcohol | 2-cyclododecyl-propanol | 226 |
| hydroxycitronellal | aliphatic aldehyde | hydroxycitronellal | 172 |
| ionone alpha | aliphatic ketone | 4-(2,6,6-trimethyl-1-cyclohexenyl-1-yl)-3-buten-2-one | 192 |
| ionone beta | aliphatic ketone | 4-(2,6,6-trimethyl-1-cyclohexen-1-yl)-3-butene-2-one | 192 |
| ionone gamma methyl | aliphatic ketone | 4-(2,6,6-trimethyl-2-cyclohexyl-1-yl)-3-methyl-3-buten-2-one | 206 |
| iso E super | aliphatic ketone | 7-acetyl-1,2,3,4,5,6,7,8-octahydro-1,1,6,7,tetramethyl naphthalene | 234 |
| iso eugenol | ether | 2-methoxy-4-(1-propenyl) phenol | 164 |
| iso jasmone | aliphatic ketone | 2-methyl-3-(2-pentenyl)-2-cyclopenten-1-one | 166 |
| Koavone | aliphatic aldehyde | acetyl di-isoamylene | 182 |
| Lauric aldehyde | aliphatic aldehyde | lauric aldehyde | 184 |
| Lavandin | natural | | |
| Lavender | natural | | |
| Lemon CP | natural | major component d-limonene | |
| d-limonene/orange terpenes | alkene | 1-methyl-4-iso-propenyl-1-cyclohexene | 136 |
| Linalool | alcohol | 3-hydroxy-3,7-dimethyl-1,6-octadiene | 154 |
| linalyl acetate | ester | 3-hydroxy-3,7-dimethyl-1,6-octadiene acetate | 196 |
| lrg 201 | ester | 2,4-dihydroxy-3,6-dimethyl benzoic acid methyl ester | 196 |
| Lyral | aliphatic aldehyde | 4-(4-hydroxy-4-methyl-pentyl) 3-cylcohexene-1-carboxaldehyde | 210 |
| Majantol | aliphatic alcohol | 2,2-dimethyl-3-(3-methylphenyl)-propanol | 178 |
| Mayol | alcohol | 4-(1-methylethyl) cyclohexane methanol | 156 |
| methyl anthranilate | aromatic amine | methyl-2-aminobenzoate | 151 |
| methyl beta naphthyl ketone | aromatic ketone | methyl beta naphthyl ketone | 170 |
| methyl cedrylone | aliphatic ketone | methyl cedrenyl ketone | 246 |
| methyl chavicol | ester | 1-methyloxy-4,2-propen-1-yl benzene | 148 |
| methyl dihydro jasmonate | aliphatic ketone | methyl dihydro jasmonate | 226 |
| methyl nonyl acetaldehyde | aliphatic aldehyde | methyl nonyl acetaldehyde | 184 |
| Musk indanone | aromatic ketone | 4-acetyl-6-tert butyl-1,1-dimethyl indane | 244 |

-continued

| Common Name | Chemical Type | Chemical Name | ~M.W. |
|---|---|---|---|
| Nerol | alcohol | 2-cis-3,7-dimethyl-2,6-octadien-1-ol | 154 |
| Nonalactone | lactone | 4-hydroxynonanoic acid, lactone | 156 |
| Norlimbanol | aliphatic alcohol | 1-(2,2,6-trimethyl-cyclohexyl)-3-hexanol | 226 |
| orange CP | natural | major component d-limonene | |
| P.T. bucinal | aromatic aldehyde | 2-methyl-3(para tert butylphenyl) propionaldehyde | 204 |
| para hydroxy phenyl butanone | aromatic ketone | para hydroxy phenyl butanone | 164 |
| Patchouli | natural | | |
| phenyl acetaldehyde | aromatic aldehyde | 1-oxo-2-phenylethane | 120 |
| phenyl acetaldehyde dimethyl acetyl | aromatic aldehyde | phenyl acetaldehyde dimethyl acetyl | 166 |
| phenyl ethyl acetate | ester | phenyl ethyl acetate | 164 |
| phenyl ethyl alcohol | alcohol | phenyl ethyl alcohol | 122 |
| phenyl ethyl phenyl acetate | ester | 2-phenylethyl phenyl acetate | 240 |
| phenyl hexanol/phenoxanol | alcohol | 3-methyl-5-phenylpentanol | 178 |
| Polysantol | aliphatic alcohol | 3,3-dimethyl-5-(2,2,3-trimethyl-3-cyclopenten-1-yl)-4-penten-2-ol | 221 |
| phenyl acetate | ester | 2-methylbuten-2-ol-4-acetate | 128 |
| Rosaphen | aromatic alcohol | 2-methyl-5-phenyl pentanol | 178 |
| Sandalwood | natural | | |
| alpha-terpinene | aliphatic alkane | 1-methyl-4-iso-propylcyclohexadiene-1,3 | 136 |
| terpineol (alpha terpineol and beta terpineol) | alcohol | para-menth-1-en-8-ol, para-menth-1-en-1-ol | 154 |
| terpinyl acetate | ester | para-menth-1-en-8-yl acetate | 196 |
| tetra hydro linalool | aliphatic alcohol | 3,7-dimethyl-3-octanol | 158 |
| tetrahydromyrcenol | aliphatic alcohol | 2,6-dimethyl-2-octanol | 158 |
| tonalid/musk plus | aromatic ketone | 7-acetyl-1,1,3,4,4,6-hexamethyl tetralin | 258 |
| undecalactone | lactone | 4-N-heptyl-4-hydroxybutanoic acid lactone | 184 |
| Undecavertol | alcohol | 4-methyl-3-decen-5-ol | 170 |
| undecyl aldehyde | aliphatic aldehyde | undecanal | 170 |
| undecylenic aldehyde | aliphatic aldehyde | undecylenic aldehyde | 168 |
| Vanillin | aromatic aldehyde | 4-hydroxy-3-methoxybenzaldehyde | 152 |
| Verdox | ester | 2-tert-butyl cyclohexyl acetate | 198 |
| Vertenex | ester | 4-tert-butyl cyclohexyl acetate | 198 |

Mixtures of two or more of such materials may also be employed.

It is often desirable in the scented candle industry to incorporate highly volatile perfumes. Perfume agents may therefore be further identified on the basis of their volatility. Boiling point is used herein as a measure of volatility.

Typically, during the conventional candle manufacturing process, a substantial amount of perfume that is added to the candle manufacturing material is lost during the heating phase. This has resulted in limitations on the type of perfumes that may be employed, waste of perfumes that are volatized during the manufacturing process, and a contribution to the general air pollution from the release of volatile organic compounds to the air. Generally then, the scented candle industry has restricted the available perfumes to those known as enduring perfumes, characterized by their boiling points (B. P.) and their ClogP value. The enduring perfume ingredients normally have a B. P, measured at the normal, standard pressure of 760 mm Hg, of about 240° C. or higher, or about 250° C. or higher, and a ClogP of about 2.7 or higher, about 2.9 or higher, or about 3.0 or higher. However, according to the invention, other perfume actives with boiling points less than about 240° C. and with a ClogP of less than about 2.7 can be employed when the perfume active is loaded onto a perfume carrier.

As described in U.S. Pat. No. 5,500,138, issued Mar. 19, 1996 to Bacon and Trinh, incorporated herein by reference, the ClogP of an active is a reference to the "calculated" octanol/water partitioning coefficient of the active and serves as a measure of the hydrophobicity of the perfume active. The ClogP of an active can be calculated according to the methods quoted in "The Hydrophobic Fragmental Constant" R. F. Rekker, Elsevier, Oxford or Chem. Rev, Vol. 71, No. 5, 1971, C. Hansch and A. I. Leo, or by using a ClogP program from Daylight Chemical Information Systems, Inc. Such a program also lists experimental logP values when they are available in the Pomona92 database. The "calculated logP" (ClogP) can be determined by the fragment approach of Hansch and Leo (cf., A. Leo in Comprehensive Medicinal Chemistry, Vol. 4, C. Hansch, P. G. Sammens, J. B. Taylor, and C. A. Ramsden, Eds. p 295, Pergamon Press, 1990). The fragment approach is based on the chemical structure of each compound and takes into account the numbers and types of atoms, the atom connectivity, and chemical bonding.

The boiling points of many perfume ingredients are given in, e.g., "Perfume and Flavor Chemicals (Aroma Chemicals)," Steffen Arctander, published by the author, 1969, incorporated herein by reference. Other boiling point values can be obtained from different chemistry handbooks and data bases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure monographs, such as those given in "The Chemist's Companion," A. J. Gordon and R. A. Ford, John Wiley & Sons Publishers, 1972, pp. 30-36. The boiling point values can also be estimated via a computer program that is described in "Development of a Quantitative Structure—Property Relationship Model for Estimating Normal Boiling Points of Small Multifunctional Organic Molecules", David T. Stanton, Journal of Chemical Information and Computer Sciences, Vol. 40, No. 1, 2000, pp. 81-90.

The perfume active may also include pro-fragrances such as acetal profragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g. triggered by a pH drop) or may be enzymatically releasable pro-fragrances. These pro-fragrances, pro-perfumes, pro-accords, and mixtures thereof hereinafter are known collectively as "pro-fragrances". The pro-fragrances of the present invention can exhibit varying release rates depending upon the pro-fragrance chosen.

In addition, the pro-fragrances of the present invention can be admixed with the fragrance raw materials that are released therefrom to present the user with an initial fragrance, scent, accord, or bouquet. Further, the pro-fragrances of the present invention can be suitably admixed with any carrier provided the carrier does not catalyze or in other way promote the pre-mature release form the pro-fragrance of the fragrance raw materials.

Pro-fragrances for use in the compositions of the present invention are suitably described in the following: U.S. Pat. No. 5,378,468, Suffis et al., issued Jan. 3, 1995; U.S. Pat. No. 5,626,852, Suffis et al., issued May 6, 1997; U.S. Pat. No. 5,710,122, Sivik et al., issued Jan. 20, 1998; U.S. Pat. No. 5,716,918, Sivik et al., issued Feb. 10, 1998; U.S. Pat. No. 5,721,202, Waite et al., issued Feb. 24, 1998; U.S. Pat. No. 5,744,435, Hartman et al., issued Apr. 25, 1998; U.S. Pat. No. 5,756,827, Sivik, issued May 26, 1998; U.S. Pat. No. 5,830,835, Severns et al., issued Nov. 3, 1998; U.S. Pat. No. 5,919,752, Morelli et al., issued Jul. 6, 1999; WO 00/02986 published Jan. 20, 2000, Busch et al.; and WO 01/04248 published Jan. 18, 2001, Busch et al., all of which are incorporated herein by reference.

Optionally, the perfume active or mixture of actives may be combined with a perfume fixative. The perfume fixative materials employed herein are characterized by several criteria that make them especially suitable in the practice of this invention. Dispersible, toxicologically acceptable, non-skin irritating, inert to the perfume, degradable, available from renewable resources, and/or relatively odorless fixatives are used. The use of perfume fixatives is believed to slow the evaporation of more volatile components of the perfume.

Examples of suitable fixatives include members selected from the group consisting of diethyl phthalate, musks, and mixtures thereof. If used, the perfume fixative may comprise from about 10% to about 50%, and preferably from about 20% to about 40%, by weight of the perfume.

The present invention allows incorporation of the typically avoided highly volatile perfumes, defined herein as those perfumes into the candle with boiling points less than about 240° C., and ClogP values less than about 2.7, via incorporation of the perfume-loaded porous inorganic carrier particle.

b) Porous Inorganic Carrier Particles:

As used herein, "porous inorganic carrier particles" include porous solids onto which the perfume is loaded for incorporation into the candle manufacturing material and from which the perfume may be released. Suitable porous inorganic carrier particles include, but are not limited to, porous solids selected from the group consisting of amorphous silicates, crystalline non-layer silicates, layered silicates, calcium carbonates, calcium/sodium carbonate double salts, sodium carbonates, silica, ceramic clays, bentonite, zeolites, sodalites, phosphorous-based compounds such as alkali metal phosphates, macroporous zeolites, chitin microbeads, other synthetic and natural minerals, foams, and the like. As an example, U.S. Pat. No. 4,954,285 issued to Wierenga et al. teaches the adsorption of perfume onto silica particles to form a perfume particle for use in fabric softening applications, the description of this patent being incorporated herein by reference.

In one embodiment, the carrier particles comprise one or more zeolites, and in a more specific embodiment, the inorganic carrier particles comprise zeolite X. One of such inorganic materials or mixtures of two or more of such inorganic materials are employed as a means to deliver fragrances in a controlled manner. The carrier particles typically have a mean particle size of from about 0.1 to about 1150 microns. In one embodiment, the carrier particles have a mean particle size of from about 1 to about 100 microns, and more specifically from about 5 to about 60 microns.

The term "zeolite" as used herein refers to a crystalline aluminosilicate material. The structural formula of a zeolite is based on the crystal unit cell, the smallest unit of structure represented by $$Mm/n[AlO_2)m(SiO_2)y]x\ H_2O$$

wherein m/n is the valence of the cation M, x is the number of water molecules per unit cell, m and y are the total number of tetrahedral per unit cell, and y/m is 1 to 100. In a specific embodiment, y/m is from about 1 to about 5. The cation M can be a Group IA and/or Group IIA element, such as sodium, potassium, magnesium, calcium, and mixtures thereof. Aluminosilicate zeolite materials useful in the practice of this invention are commercially available. A specific zeolite advantageous for use herein is a faujasite-type zeolite including Type X Zeolite, with nominal pore size of about 8 Å, typically in the range of about 7.4 to about 10 Å. Methods for producing X-type Zeolites are well known in the art.

For purposes of illustration and not by way of limitation, in a specific embodiment, the crystalline aluminosilicate material is Type X, and, in a further embodiment, is selected from the following:

$$Na_{86}[AlO_2]_{86}.(SiO_2)_{106}.xH_2O, \quad (I)$$

$$K_{86}[AlO_2]_{86}.(SiO_2)_{106}.xH_2O, \quad (II)$$

$$Ca_{40}Na_6[AlO_2]_{86}.(SiO_2)_{106}.xH_2O, \quad (III)$$

$$Sr_{21}Ba_{22}[AlO_2]_{86}.(SiO_2)_{106}.xH_2O, \quad (IV)$$

and mixtures thereof, wherein x is from about 0 to about 276. Zeolites of Formula I and II have a nominal pore size or opening of about 8.4 Å. Zeolites of Formulas III and IV have a nominal pore size or opening of about 8.0 Å.

Different zeolites have a variety of different sizes and physical characteristics. Zeolites suitable for use in the present invention are in particle form having, for example, an average particle size from about 0.1 microns to about 250 microns, from about 0.1 microns to about 30 microns, or from about 1 micron to about 5 microns, as measured by standard particle size analysis techniques (such as light scattering). A zeolite or mixture of different zeolites are a preferred perfume carrier for the present inventive candle.

In addition to inorganic carrier materials, organic materials that can be used as perfume carriers may be manufactured into microcapsules via a variety of processes (e.g. interfacial polymerization, coacervation, emulsion polymerization, suspension polymerization, spray drying, freeze drying, fluid bed drying) with a variety of starting materials such as polyethylene, polystyrene, polyvinyl alcohol, and polyethylene glycols. U.S. Pat. No. 5,112,688, issued May 12, 1992 to Michael describes the microencapsulation of perfume materials using coacervation processes, and is incorporated herein by reference. Similarly, U.S. Pat. No. 6,194,375, issued to Ness et al., teaches perfume absorbed within organic polymer particles, specifically, highly hydrolyzed polyvinyl alcohols.

The term "loaded" as used herein is defined as entrapment of the perfume in the porous carrier particles. For example, and not to be limited by theory, it is believed that perfume entrapment in the porous inorganic carrier particles, for example, zeolite, involves key physical and chemical transformations including: (1) perfume adsorption onto the particle surface, (2) perfume diffusion into the particle cavities, (3) the "binding" of perfume active to a site in the particle cavity, (4) intermolecular interactions which lead to selective entrapment of materials in a specific order, (5) the distortion of the structural lattice of the particle cavity, and/or (6) the binding of perfume molecules to various sites, near the surface as well as within the pores.

Where the perfume is to be adsorbed onto the porous inorganic carrier particle, the perfume raw materials or mixtures of perfume raw materials may be selected according to the description provided in U.S. Pat. No. 5,955,419 issued Sep. 21, 1999, to Barket, Jr., et al., which is incorporated herein by reference. Release requires movement of the perfume out of the particle pores with subsequent partitioning into the air around the candle.

While not intending to be bound by theory, it is believed that release of the perfume is triggered by adsorption of water into the pores, and that heat is not the single trigger for perfume release from the porous cavity. Hence, the problem of premature release of perfume during the candle making process is avoided. Exposure of the finished candle to ambient humidity frees up perfume within the porous particle cavity to diffuse out to the particle surface and into the candle manufacturing material for subsequent diffusion into the candle's environment. In this way, the perfume components can gradually diffuse into the candle's environment both during storage and when lit. Thus, by providing heat and/or humidity as triggers to release the perfume, the porous inorganic carrier particles, such as zeolites, allow for more effective control over the delivery of fragrance from the inventive candle.

While a variety of zeolites having different properties are commercially available, zeolites may also be prepared using methods well known in the art. Specifically, there are three primary methods for synthesis of zeolites, namely, (1) the hydrogel method which employs reactive oxides, soluble silicates, soluble aluminates, and caustic to produce high purity powders or zeolites in a gel matrix; (2) a clay conversion method which employs raw minerals such a kaolin and faujisite, soluble silicates and caustic to produce low to high purity powder or zeolite in clay derived matrix; and (3) processes based on the use of naturally occurring raw materials e.g. natural silica, acid treated clay, volcanic glass, amorphous minerals, to yield high purity powders and zeolites on ceramic supports. A preferred process for making a humidity triggered release zeolite is the hydrogel method. A preferred type of zeolite for use in humidity-triggered release of perfume is the X type zeolites.

Where the carrier particles are zeolites, it has been discovered that the selection of zeolites that have the surface area characteristics described below provide improved perfume adsorption. Types X and Y zeolites have a nominal pore sizes ranging from about 7.4 to about 10 Å, which is suitable for diffusion of perfume molecules into the zeolite cavity. Although pore size distribution and silicon to aluminum ratio (hydrophobicity of cavity), cation, and moisture content are critical screening tools for selection among various types of zeolites such as zeolites A, X, Y, etc., there has previously been little guidance criteria for selecting a preferred zeolite from a given type of zeolites e.g. type X zeolites, for perfume delivery applications.

An evaluation of type-X zeolites from UOP, L. L. C. (Zeolite 13X powder) and PQ Corporation (Advera 201N powder) confirmed that although Zeolite 13X and Advera 201N have an identical chemical composition, particle size distribution, cation, and pH (1 wt % aqueous dispersion), there is a significant difference in BET surface area between these two type X zeolites. BET surface area is an estimate of the total adsorption area of a nitrogen monolayer adsorption in a porous particle. The procedure, well known to those familiar in the art, consists of several steps including (1) placing the porous particles in a glass tube, approximately ½ full, (2) applying a high vacuum to remove adsorbed species, (3) cooling of the powder sample to approximately 76 Kelvin, (4) evaluating the adsorptive capacity of the powder as a function of the partial pressure of nitrogen injected into the tube. The adsorption data is then organized to yield a total surface area for nitrogen adsorption (monolayer). In order to avoid erroneous results, a change in the standard protocol for BET surface area measurement is recommended, namely, do not purge the powder sample with liquid nitrogen for 24 hours prior to analysis as the zeolite may begin to adsorb water vapor from ambient conditions during the purge operation, resulting in a high standard deviation in the BET surface area results (33 $m^2/g$ compared to 3 $m^2/g$).

The BET surface area data for Zeolite 13X and Advera 201N are tabulated below. Advera 201N and Zeolite 13X (both type X zeolites) had an average BET surface area of 587 $m^2/g$ and 478 $m^2/g$ respectively.

Gemini BET surface area measurement for UOP Zeolite 13X

| Total Moisture Content (wt %) | Nitrogen Purge Time (hrs) | Zeolite Source | BET Surface Area ($m^2/g$) |
|---|---|---|---|
| 6.8% | 0 | 13X from UOP | 587 |
| 6.8% | 0 | 13X from UOP | 585 |
| 6.8% | 0 | 13X from UOP | 588 |
| 6.8% | 0 | 13X from UOP | 589 |
| 6.8% | 0 | 13X from UOP | 588 |
| 6.8% | 0 | 13X from UOP | 586 |
| 6.8% | 0 | 13X from UOP | 589 |
| 12.8% | 0 | 13X from UOP | 359 |
| 20.7% | 0 | 13X from UOP | 13 |
| 6.8% | 3.75 | 13X from UOP | 507 |

-continued

| Total Moisture Content (wt %) | Nitrogen Purge Time (hrs) | Zeolite Source | BET Surface Area ($m^2/g$) |
|---|---|---|---|
| 6.8% | 8.0 | 13X from UOP | 555 |
| 6.8% | 23.0 | 13X from UOP | 559 |
| 6.8% | 24 | 13X from UOP | 576 |
| 6.8% | 24 | 13X from UOP | 594 |
| 8.0% | 0 | Advera 201N-PQ | 477 |
| 8.0% | 0 | Advera 201N-PQ | 479 |
| 8.0% | 0 | Advera 201N-PQ | 473 |
| 8.0% | 0 | Advera 201N-PQ | 482 |
| 8.0% | 0 | Advera 201N-PQ | 476 |
| 8.0% | 0 | Advera 201N-PQ | 478 |

Generally, zeolites useful in the candles and methods of the present invention are described in U.S. Pat. No. 5,955,419 issued Sep. 21, 1999, to Barket, Jr. et al., which is incorporated herein by reference. The zeolite materials useful in the practice of this invention are commercially available.

Wick Materials

At least one wick is included in the candle. The wick should be sufficiently thick so that it is not so small as to drown in a pool of molten wax as the candle burns, but not so excessively thick so as to cause the candle to smoke, drip excessively, and/or burn quickly. Typically, wicks are made of braided cotton in many different diameters, ranging from about 0.375 inches to about 3.75 inches.

Wick materials can also be comprised of non-cotton materials, such as silica gel, mixtures of granular powders, mixtures of edible powders (U.S. Pat. No. 6,099,877, Schuppan, Aug. 8, 2000), or polymeric matrices (U.S. Pat. Nos. 5,919,423, Requejo, et al., Jul. 6, 1999, and U.S. Pat. No. 6,013,231, Zaunbrecher, et al. Jan. 11, 2000) all of which are incorporated herein by reference. A polymeric matrix can be selected from the class of thermoplastic resins that can be formed into fibers by processes such as extrusion or compression molding. Obviously, it is preferred that the polymer comprises chemicals that do not convert into noxious vapors under combustion conditions. Such fiber-forming processes are disclosed in U.S. Pat. Nos. 3,065,502, 3,351,695, 3,577,588, 4,134,714, Driskill, Jan. 16, 1979, U.S. Pat. No. 4,302,409, Miller et al., Nov. 24, 1981, and U.S. Pat. No. 5,320,798, Chambon, et al., Jun. 14, 1994, all incorporated herein by reference. Suitable polymers include hydrocarbyl polyolefinic derivatives such as low and high density polyethylene, polypropene, polybutene, polystyrene, and the like. Others include polyvinyl acetate, and acrylate resins such as polymethyl acrylate, polymethyl methacrylate, polybutyl methacrylate, and poly(ethylacrylate/ethylene). Thermoset resins can also be used. Other components can be included in the wick composition such as stearic acid, polyoxyalkene glycol, and the like. Cellulosic (beta-glucosidic polysaccharides) filler ingredients obtained from vegetable sources such as cotton, linen, ayon, flax, hemp, jute, wood pulp, cellulose, and mixtures thereof, can be added as well.

The transport of melted wax can be enhanced by one or more capillary grooves extending axially along the surface of the wick filament. Stiffening agents can also be added to the wick filaments to maintain wick rigidity and to avoid the wick material drowning in a pool of wax as the candle bums. Such stiffening agents are described in U.S. Pat. No. 3,940,233, Fox, et al., Feb. 24, 1976, and are incorporated herein by reference. Alternatively, the wick can be constructed of a single strand of tufted wire coil having a polymeric coating described above.

Incorporation of inorganic materials into the candle manufacturing material may influence the size of the wick. Typically, sintering, or melting of inorganic materials onto the wick undesirably reduces the venturi effect of "wicking" wax, because the materials effectively reduce the surface area of the wick. In the case of a braided cotton wick, the ratio of the surface area of wick to quantity of inorganic carrier incorporated into the candle influences the burning rate and, thus, burning time for the candle. When the wick is contained within a portion of a candle manufacturing material comprising the perfume-loaded inorganic carrier particles dispersed throughout, problems caused by sintering of inorganic particles onto the wick can be avoided by controlling the ratio of the total surface area of the wick to the total surface area of the perfume-loaded inorganic carrier particles therein, such that enough of the wick surface is left to sufficiently propagate the flame despite some accumulation of unburned carrier particle residue on the wick. The suitable ratio of wick surface area to total surface area of perfume-loaded inorganic carrier particles is from about 5:1 to about 100:1 or more specifically from about 10:1 to about 20:1.

The following procedure can be used to determine the wick diameter required for a particular mass of inorganic particles. First, load the inorganic particle with the desired perfume to a maximum level and calculate the particle density of the inorganic carrier particles using any of the well known techniques in the art such as helium pycnometer, mercury porosimetry, immiscible liquid column, etc. Then obtain the volume average particle size by measuring the particle size distribution of the inorganic particle, either loaded or unloaded with active material, using any of the well known techniques, although laser light scattering techniques are preferred for their accuracy. For purposes of determining an appropriate wick size it is acceptable to assume a spherical geometry for the particle, and thus, the surface area of an individual particle may be calculated based on the formula $4\pi r^2$, where r is the measured volume average radius of the inorganic particle. The particle density, together with the particle volume, is then used to estimate the number of individual particles per unit gram of inorganic carrier powder, e.g. 1 g of powder contains N particles (where N=(particle density) $(4/3\pi r^3)^{-1}$ and where density is in grams per cubic centimeter and r is in centimeters). The total surface area of perfume loaded inorganic carrier is then given by $4\pi r^2 N$.

The total wick surface area will depend on the wick material used (e.g. the number of fiber strands used to form a wick). The wick surface area of interest is the total surface area of the fibers. Measurement of surface area of fibers is well known by such techniques as nitrogen adsorption/desorption (BET Surface area via physisorption) (Blair and McElroy, Journal of Applied Polymer Science, 20:2955-2967, 1976). Although nitrogen adsorption/desorption is one of the most important methods for measuring the surface area of fibrous materials, the measured value is attributed mainly to the external surface of bundled fibers whereas it is well known that the internal surface area is also important for wicking. Kaewprasit, et al. (Journal of Cotton Science, 2:164-173, 1998) describe a technique for total surface area measurement, using adsorption of methylene blue. The authors show that the total surface area of cotton fibers is in the range 30 to 55 square meters per gram (where 6 different types of cotton fibers were evaluated).

EXAMPLE 1

Selection of Wick 30 g of Paraffin Wax (Crafty Candles, melting point 55-60 degrees Centigrade) was melted and placed into a cylindrical mold. 0.3 g of perfume loaded porous inorganic carrier particles (85 wt % zeolite 13X, 15 wt % Golden Eye perfume oil) is desired in the final candle product. Confirmation that 0.1173 g of a braided wick (BW-1 from Crafty Candles, 5.9 cm total braided wick length that is exposed to wax) is sufficient to ensure complete burning of the candle was calculated in the manner outlined below (assumes a 13:1 wick surface area to particle surface area for complete burning).

Perfume Loaded Porous Inorganic Carrier Particles

Mean Volume Average Particle Size=5.0 micrometers

Particle Density=1.8 grams per cubic centimeter $N=8.49\times10^9$ particles per gram Particle Surface Area=0.66 $m^2/g\times0.255$ g zeolite=0.17 $m^2$ Candle Wick Required Surface Area=$13\times0.17$ $m^2=2.2$ $m^2$ Available Surface Area of Cotton Fibers=0.1173 $g\times30$ $m^2/g=3.5$ $m^2$ Since the available surface area from the braided wick is greater than the required, the available wick will be sufficient to allow complete burning of the candle.

In another embodiment of the present invention, the wick is contained within a portion of the candle manufacturing material comprising encapsulated perfume-loaded porous inorganic carrier particles, examples of which are discussed below, dispersed throughout. Encapsulation of the porous inorganic carrier particles can reduce and/or eliminate the undesirable sintering effect. In yet another embodiment, the wick is contained within a first portion of the candle manufacturing material substantially free of perfume-loaded inorganic carrier particles, and optionally comprising small amounts of neat perfume, and the candle further comprises at least one additional portion containing the perfume-loaded particles. In this embodiment, the additional portion may optionally have a boiling point lower than that of the first portion.

Optionally, the perfume-loaded porous inorganic carrier particle can be further provided with a barrier, for example to control release of the perfume active and/or to achieve better burning of the candle. Specifically, the perfume-loaded porous inorganic carrier particles may be further processed with barrier technologies such as encapsulation or coating to control the release of the perfume active, or to achieve better burning of the candle by insulating the inorganic carrier from the wick. Non-limiting examples of processes which can be used to encapsulate the perfume-loaded porous inorganic carrier particles include: spray drying, freeze drying, vacuum drying, extrusion, coacervation, interfacial polymerization, prilling, or other microencapsulation processes known in the art. The encapsulated perfume-loaded porous inorganic carrier particles are then dispersed within the candle manufacturing material. Non-limiting examples of materials suitable for use as a barrier include, but are not limited to, water soluble copolymers such as hydroxylalkyl acrylate or methacrylate, gelatin (U.S. Pat. Nos. 3,681,089 and 3,681,248 and WO 9828396 A1), polyacrylates, quaternary ammonium salts, acrylic resins, cellulose acetate phthalate, hydrocarbon waxes (U.S. Pat. Nos. 4,919,441, Marier et al., Apr. 24, 1990, U.S. Pat. No. 5,246,603, Tsaur et al., Sep. 21, 1993, U.S. Pat. No. 5,185,155, Behan et al., Feb. 9, 1993, U.S. Pat. No. 5,500,223, Behan et al., Mar. 19, 1996, EP Nos. 382 464A, 478 326A, 346 034A), urea-formaldehyde resin, polycaprolactone melt, lactic acid, modified starches (U.S. Pat. No. 3,971,852, Brenner et al., Jul. 27, 1976 and U.S. Pat. No. 5,354,559, Morehouse, Oct. 11, 1994), gums, and hydrolysable polymers.

The scented candles of the invention may be manufactured by loading the porous inorganic carrier particles with perfume, adding the perfume-loaded porous inorganic carrier particles to the candle manufacturing material, and providing the candle manufacturing material with a wick. In one embodiment, the porous inorganic carrier particle to be loaded with perfume active comprises zeolite, for example, zeolite X. The step of "loading" the porous inorganic carrier particle involves contacting the carrier particles with a perfume composition, mixing the carrier and perfume, allowing heat to be generated as the perfume enters the carrier and then cooling the mixture.

In one embodiment, the porous inorganic carrier particles, for example, zeolites, to be used herein contain less than about 10% desorbable water, more preferably less than about 8% desorbable water and even more preferably less than about 5% desorbable water. Such materials may be obtained by first activating/dehydrating by heating, for example, zeolite at from about 150° C. to about 350° C., optionally at a reduced pressure of from about 0.001 to about 20 Torr, for at least about 12 hours. After this "activation", the perfume composition is thoroughly mixed with the activated zeolite and, optionally, heated to about 60° C. for up to two hours to accelerate absorption equilibrium within the zeolite particles. The perfume zeolite mixture is then cooled to room temperature, under controlled humidity conditions, at which time the mixture is in the form of a free flowing powder. Similar processes are employed with carrier particles other than zeolites.

The amount of perfume active incorporated into the particle cavity can vary widely depending on the perfume composition type, the particle composition and the physical characteristics thereof. Generally, the perfume active may be incorporated in an amount of from about 1% to about 95% by weight of the particles, and more specifically, from about 5% to about 50% by weight of the particles. In one embodiment, the perfume active comprises less than about 20%, typically less than abut 18.5%, by weight of the loaded particle, given the limits on the pore volume of the particles. The particles may comprise more than 20% by weight of perfume agents, but may include excess perfume agents not incorporated into the pores. This optional excess of "free" perfume may provide a desirable immediate "bloom" of the fragrance upon exposure to humidity.

The adsorption of perfume molecules into porous particles such as a zeolite cavity is governed by two stages, (1) the thermodynamics during initial entrapment, and (2) entropy control at higher levels of perfume inside the cavity. At low loadings, the perfume molecule that "fits" better into the pore space is able to offer the best energy state, favoring its adsorption. At higher levels of perfume loading, there is increased demand to pack as many molecules as possible in the particle cavity and smaller molecules dominate the pore space.

Perfume adsorption into the particle cavity, such as a zeolite cavity, results in a large exothermic release of energy with a resulting temperature rise in the bulk powder of typically from about 20° to about 40° C. The energy released meets the activation energy requirements for adsorption of specific molecules and therefore influences the selectivity of perfume molecules adsorbed. Hence, by controlling the heat transfer during the perfume adsorption step it is possible to manipulate the amount of perfume adsorbed, the selectivity of the perfume molecules adsorbed into the cavity, and the retention of adsorbed perfume molecules through the manufacturing process. Allowing the perfume carrier particles to reach their maximum temperature prior to cooling accomplishes the objectives of entrapping a higher quantity of perfume active and retaining more of the adsorbed perfume through the manufacturing process.

Selectivity of perfume entrapped in the particle cavity is possible, allowing the use of perfume molecules previously avoided by the industry as too volatile to survive appreciably through the manufacturing process. Since the kinetics of adsorption of each perfume active will be different, it is advantageous to first run a "blank" (no heat removal) to prepare a temperature-time profile. From this temperature-time profile, the time at which there is a change in slope (i.e. particle temperature begins to plateau) may be estimated. This is the time at which the particle must be cooled in order to minimize evaporative losses and maximize adsorption of perfume components into the particle cavity. The amount of heat removed influences the final temperature of the particle. Since each perfume active will have a different composition of volatile components, the influence of the final temperature on perfume retention will depend on the perfume composition.

The next step comprises adding the perfume-loaded porous inorganic carrier particle to the candle manufacturing material. The candle manufacturing material, which is comprised of any of the materials listed above, is insoluble with the porous inorganic carrier particles loaded with perfume. It is thoroughly mixed with the perfumed-loaded carrier and, thereby, entraps and "protects" the perfume in the carrier.

In one aspect of the inventive method, the perfume-loaded porous inorganic carrier particles are admixed throughout the candle manufacturing material. The particles may be incorporated directly into the melted material, for example, wax, or the particles may be dry added to the particles of the material. In a second aspect of the inventive method, perfume-loaded porous inorganic carrier particles are admixed throughout at least one portion of the candle manufacturing material while there remains is at least one portion of the candle manufacturing material essentially free of the perfume-loaded porous inorganic carrier particles and in which a wick is contained. In one embodiment of the present invention, the portion of the candle containing the wick is separated from the portion of the candle manufacturing material containing the porous inorganic carrier particle by an encapsulating barrier. Such barriers are suitably comprised of the barrier materials listed above. In a further embodiment, the perfume-loaded porous inorganic carrier particles may be dusted on exterior surfaces of a molded candle.

The inventive method further comprises placement of at least one wick within the candle manufacturing material. In one aspect of the invention, at least one wick is placed in the portion of the candle manufacturing material comprising the perfume-loaded porous inorganic carrier particle dispersed throughout. A second aspect of the inventive method comprises dispersing the perfume-loaded porous inorganic carrier particles in at least one portion, and placing at least one wick in a portion of the candle manufacturing material essentially free of perfume-loaded porous inorganic carrier particles. A third aspect of the inventive method comprises placing at least one wick in candle manufacturing material comprising encapsulated perfume-loaded porous inorganic carrier particles. Two or more wicks may be employed as desired.

A specific embodiment of the invention comprises a scented candle comprising a first portion comprising paraffin wax and a wick, and being essentially free of any perfume-loaded porous inorganic carrier particles, and a second portion comprising encapsulated perfume-loaded zeolite X particles dispersed throughout the candle manufacturing material, the perfume thereof being highly volatile. Optionally, the boiling point of the second portion is at least 10° less than the boiling point of the first portion. In yet a further embodiment, the first and second portions from adjacent, concentric vertical layers.

The candles according to the present invention provide intense, long-lasting fragrance. While conventional candles tend to release their perfume rapidly at first such that the odor intensity noticeably drops off after initial display or burning, the candles according to the present invention provide a more gradual and even release of the perfume over time. Thus, the candles according to the present invention provide higher odor intensity after storage as compared with many conventional candles, both when the candle is burned and when the candle is displayed without burning.

As discussed in detail above, it is believed that the perfume release from the perfume-loaded porous inorganic carrier particles is triggered both by humidity and heat. A preferred perfume loaded carrier to achieve this effect is zeolite X. Heating of the perfume loaded zeolite X carrier during the manufacturing process (at <10% relative humidity) results in nil perfume oil loss, thus providing a way to deliver volatile perfume components from a candle. Subsequent exposure of the candle to humidity frees up perfume components for diffusion out of the porous cavity.

EXAMPLE 2

Perfume Loss Due To Heat Exposure

A Mettler Toledo Basic Level LJ16 Moisture Analyzer was used to measure total volatiles from perfume-loaded porous inorganic carrier particles. The Mettler Toledo balance measures the total weight loss of sample after a selected temperature/time treatment. The particles were subjected to a high temperature treatment, 160 degrees Centigrade for up to 20 minutes. Total volatile fraction from perfume-loaded porous inorganic carrier particles (zeolite 13X which has been loaded with 15 wt % perfume) is tabulated in Table 1.

TABLE 1

| Temperature/Time | Total Volatiles (wt %) (±0.50 wt %) |
|---|---|
| 160° C./5 minutes | 1.8% |
| 160° C./10 minutes | 1.6% |
| 160° C./15 minutes | 1.6% |
| 160° C./20 minutes | 1.1% |

Subsequent exposure of the candle to humidity frees up perfume components for diffusion out of the porous cavity.

In a specific embodiment of the invention, the candle is provided in a package having water and/or humidity resistance. Such packaging therefore prevents initiation of the perfume release prior to opening of the package by a consumer. Various water or humidity resistant packaging forms will be apparent to one of ordinary skill in the art and may include, for example, plastic wraps, glass or plastic containers and the like. In yet a further embodiment, such a packaging is provided with a label that enables a consumer to sense the fragrance of the candle without opening of the packaging. Again, the form of such labels will be apparent to those of ordinary skill in the art. One example comprises a "scratch-and-sniff" type label wherein rubbing of the label releases sufficient fragrance for the consumer to sense the candle fragrance without opening of the package. Another example comprises the use of perfume loaded zeolite X in an adhesive "sticker" whose design allows exposing the carrier to ambient humidity in order to release sufficient fragrance for the consumer to sense the candle fragrance without opening or lighting the candle.

The preceding examples and specific embodiments disclosed herein are provided for illustrative purposes only. Additional embodiments and advantages of the present invention will be apparent to those skilled in the art and are within the scope of the present invention.

EXAMPLE 3

Agglomerate Preparation 15.0 g of Golden Eye perfume was added drop-wise to 85.0 g of zeolite X, under high agitation, in a conventional kitchen blender (Cuisinart Custom 11 blender) to obtain 100 g of perfume-loaded porous inorganic carrier particles. 57.0 g of Paraffin wax (Crafty Candles, melting point 55-60 degrees Centigrade) was melted, and added drop-wise to a 77 g of perfume-loaded porous inorganic carrier particles being intensely mixed in a conventional kitchen blender to make agglomerates.

Perfume Oil Candle—Melt Cooling 0.44 g of Golden Eye perfume oil was added to 90.0 g of molten paraffin wax, 60 degrees Centigrade, to form a candle (cylindrical mold with a wick in place near the center of the mold). The mold was placed in ice water immediately after addition of the perfume oil to the wax.

Perfume-Loaded Agglomerate Candle—Melt Cooling 4.95 g of agglomerated powder was added to 94.0 g of molten paraffin wax, at 60 degrees Centigrade, to form a candle (cylindrical mold with a wick in place near the center of the mold). The mold was placed in ice water immediately after addition of the perfume-loaded agglomerated particles to form the candle. Direct addition of perfume-loaded porous inorganic carrier particles (without agglomeration with wax) resulted in poor dispersion of the perfume-loaded porous inorganic carrier particles in the candle wax, and an off-odor generation with particular perfumes. Addition of perfume-loaded porous inorganic carrier particles to the wax agglomerates gave uniform dispersion and no off-odors in the final candle. It also facilitated faster candle formation (heat removal via conduction and phase transition).

Perfume Oil Candle—Compressed 0.48 g of Golden Eye perfume oil was added drop-wise to 90.20 g powdered Paraffin wax (Crafty Candles) under high agitation in a conventional kitchen blender. 5.0 g of the powder was then compressed into a cylindrical tablet using Instron 5569 (serial C2545, 50 kN load cell, serial no. UK187) using 500 $lb_f$ compression force for a 25 mm diameter cylindrical die.

Perfume-Loaded Agglomerate Candle—Compressed 7.8 g of the perfume-loaded agglomerated powder was also added to 142.6 g of powdered paraffin wax (Crafty Candles) and mixed in a conventional kitchen blender. 5.0 g of the mixed powder was compressed into a cylinder using Instron 5569 (serial C2545, 50 kN load cell, serial no. UK187) using 500 $lb_f$ compression force for a 25 mm diameter cylindrical die. A hole was drilled through the center of the candle to place a wick. The neat odor of both of the perfume-loaded agglomerate candles was similar in character to candles made with perfume oil. However, the intensity of odor of the perfume-loaded agglomerate candles was significantly lower than that of the perfume oil candles. Odor longevity testing showed perfume-loaded agglomerated powder candles maintained a higher odor intensity for a longer period of time than the perfume oil candles, when the candles were used solely for decorative purposes. Burning of candles yielded a low flame height, which eventually went out after 0.75-1 hour of burning (20-30% of candle burned).

| MATERIALS | |
|---|---|
| Paraffin Wax | Crafty Candles Product #263012 |
| Zeolite 13X | UOP |

Golden Eye Perfume Formulation

A complex formulation of perfume components obtained from suppliers including Givaudan Roure Corporation, Dragoco Inc., International Flavors & Fragrances, Firmenich De Mexico S. A., Givaudan Vernier, and Haarmann & Reimer S. A.

EXAMPLE 4

70 g of HICAP 100 powdered starch (National Starch & Chemical) was dissolved in 150 g of deionized water. 30 g of Golden Eye perfume-loaded porous inorganic carrier particles (prepared as specified in Example 3) was added to the starch solution, and spray dried in a co-current Yamato dryer (Air inlet temperature of 215 degrees Centigrade, outlet temperature of 100 degrees Centigrade, drying rate of 5 mL/min solution). Two candles were prepared for evaluation:

Candle 1

1.0 g Golden Eye perfume-loaded porous inorganic carrier particles powder added to 99.0 g molten paraffin wax (Crafty Candles, melting point 55-60 degrees Centigrade), and cooled in an ice water bath immediately after addition of perfume-loaded porous inorganic carrier particles.

Candle 2

2.1 g of spray dried perfume-loaded porous inorganic carrier particles in starch particles added to 98.0 g of molten paraffin wax (Crafty Candles, melting point 55-60 degrees Centigrade), and cooled in an ice water bath immediately after addition of perfume-loaded porous inorganic carrier particles.

A burning comparison of the two candles showed that Candle 2 burned completely, with no flame propagation issues. Candle 1 flame went out prematurely, after 20-30% of the candle was burned. The perfume release rate from Candle 2 is much slower than perfume release rate from Candle 1; there is a significant decrease in odor intensity of Candle 2 when compared with Candle 1. Coating perfume-loaded porous inorganic carrier particles with organic materials, such as starch, can substantially change the completeness of burning; however, perfume release rate is also affected.

In an effort to understand the reasons for differences in candle burn profile, the burned wicks of each candle were analyzed using Scanning Electron Microscopy (SEM). This analysis showed the impact of surface area on completeness of candle burning. Zeolite sinters onto the surface of the wick, clogging pores in the wick and thereby decreasing the venturi effect of pulling in wax to support the burning of the flame. The wick surface area to total surface area of zeolite particles sintered onto the wick surface calculation showed a minimum ratio to satisfy completeness of candle burning. A ratio of 4.3-4.5 to 1 resulted in premature deflagration of the wick. A ratio of 13 to 1 was sufficient to ensure complete burning of the candle.

EXAMPLE 5

90.0 g of molten paraffin wax (Crafty Candles, melting point 55-60 degrees Centigrade) was cooled in cylindrical mold (with wick near center of the candle) to form a candle. ¼ inch exterior width of the formed candle was removed by using a utility knife. The remaining candle was left in the cylindrical mold, call this the "cut candle". 3.5 g of Golden Eye perfume-loaded porous inorganic carrier particles (manufactured in a manner specified in Example 3) was added to 46.5 g molten fatty acid (99% $C_{12}$ chain length, melting point 43 degrees Centigrade) in a cylindrical mold, mixed to achieve a uniform dispersion, and cooled to room temperature. 10.0 g of the perfume-loaded porous inorganic carrier particles+Fatty Acid mix (at 43 degrees Centigrade) was added to the mold containing the "cut candle" to fill the exterior void area (removed by utility knife). The mold contents are then cooled to make a dual layer Candle A candle comprising an inner layer of high melting paraffin wax and an outer layer of low melting perfume-loaded porous inorganic carrier particles containing fatty acid (alternatively can be a low melting wax containing perfume loaded porous inorganic carrier and perfume) was prepared. Upon burning this dual layer candle, no premature deflagration of the wick is observed, and full fragrance character can be detected. The inner wax begins to melt, and heat conduction begins to melt the outer fatty acid layer. Upon melting, the fatty acid layer drips to the bottom of the candle as the fatty acid melt has low viscosity at its melt point, eliminating "wicking" of the perfume-loaded porous inorganic carrier particles.

What is claimed is:

1. A scented candle comprising:

(a) candle manufacturing material;

(b) perfume-loaded porous inorganic carrier particles; and (c) at least one wick, wherein the perfume-loaded porous inorganic carrier particles comprise zeolite X, and further wherein the candle manufacturing material comprises at least one wax selected from the group consisting of vegetable-derived wax, animal-derived wax, mineral wax and synthetic wax, wherein the perfume-loaded porous inorganic carrier particles are dispersed throughout the candle manufacturing material.

2. A scented candle according to claim 1, wherein the candle manufacturing material further comprises at least one material selected from the group consisting of polyamide resins, aliphatic amides, aliphatic alcohols, divalent alcohols, polyvalent alcohols, emulsifiers, oils, vegetable fat, polypropylene glycol, sugars, fatty acids and combinations thereof.

3. A scented candle according to claim 1, wherein the ratio of the surface area of the wick to the mass of the perfume-loaded porous inorganic carrier particles is in the range of from about 5:1 to about 100:1.

4. A scented candle according to claim 1, wherein the wick is composed of non-cotton material.

5. A scented candle according to claim 1 wherein the candle manufacturing material comprises at least two portions, including at least one portion having the perfume-loaded inorganic carrier particles dispersed throughout, and at least one portion comprising the at least one wick and being essentially free of the perfume-loaded porous inorganic carrier particles.

6. A scented candle according to claim 1 wherein the perfume-loaded porous inorganic carrier particles are encapsulated or coated.

7. A scented candle according to claim 6 wherein the encapsulation or coating comprises at least one material selected from the group consisting of water soluble copolymers, gelatin, polyacrylates, quatemary ammonium salts, acrylic resins, cellulose acetate phthalates, hydrocarbon waxes, urea-formaldehyde resin, polycaprolactone melt, lactic acid, starches, gums, and hydrolysable polymers.

8. A scented candle according to claim 5, wherein the first portion has a melting point greater than the melting point of the second portion.

9. A scented candle according to claim 1, wherein the perfume-loaded porous inorganic carrier particles comprise highly volatile perfume.

10. A scented candle according to claim 1 wherein the zeolite X has a mean particle size of from about 0.1 micron to about 250 microns.

11. A scented candle comprising:

(a) candle manufacturing material;

(b) perfume-loaded porous inorganic carrier particles; and (c) at least one wick, wherein the perfume-loaded porous inorganic carrier particles comprise zeolite X, and wherein the candle manufacturing material comprises at least one wax selected from the group consisting of vegetable-derived wax, animal-derived wax, mineral wax, and synthetic wax, and wherein the candle manufacturing material is divided into at least two portions, including at least one portion having the perfume-loaded inorganic carrier particles dispersed throughout, and at least one portion comprising the at least one wick and being essentially free of the perfume-loaded porous inorganic carrier particles, and further wherein the scented candle is packaged in a water resistant package.

12. A scented candle according to claim 11, wherein the package comprises a label which is adapted to enable a consumer to sense the candle fragrance without opening the package.

13. A scented candle according to claim 12, wherein the label comprises an area which is adapted to release a sample of the candle fragrance upon rubbing thereof.

14. A scented candle comprising:

(a) a first portion comprising paraffin wax and a wick and being essentially free of perfume-loaded porous inorganic carrier particles; and (b) a second portion comprising paraffin wax and encapsulated perfume-loaded zeolite X particles dispersed throughout the wax, the perfume thereof being highly volatile, wherein the ratio of a surface area of the wick to the mass of the perfume-loaded zeolite X particles is from about 5:1 to about 100:1.

15. A method for manufacturing a scented candle comprising:

(a) loading porous inorganic carrier particles with perfume, wherein the porous inorganic carrier particles comprise zeolite X;

(b) providing at least two portions of candle manufacturing material, the candle manufacturing material comprising at least one wax selected from the group consisting of vegetable-derived wax, animal-derived wax, mineral wax and synthetic wax;

(c) adding the perfume-loaded porous inorganic carrier particles to at least one portion of the candle manufacturing material, and (d) providing at least one portion of the candle manufacturing material with at least one wick, wherein the at least one portion containing at least one wick does not contain perfume-loaded porous inorganic carrier particles.

16. A method according to claim 15 further comprising providing the perfume-loaded porous inorganic carrier particles with an encapsulation or coating prior to addition to the candle manufacturing material.

17. The scented candle according to claim 5, wherein the first and second portions form concentric, vertical layers.

* * * * *